United States Patent [19]

Mangini et al.

[11] Patent Number: 4,976,351

[45] Date of Patent: Dec. 11, 1990

[54] KIT FOR DISTRIBUTING PHARMACEUTICAL PRODUCTS

[75] Inventors: Richard J. Mangini, Redwood City; William J. Hartig, Pleasanton, both of Calif.

[73] Assignee: Pharmedix, Hayward, Calif.

[21] Appl. No.: 359,514

[22] Filed: Jun. 1, 1989

[51] Int. Cl.[5] ..... B65D 69/00

[52] U.S. Cl. ..... 206/232; 206/459; 206/534; 206/562; 206/564; 40/310

[58] Field of Search ..... 206/232, 459, 472, 528, 206/534, 564, 562, 563, 530; 40/310

[56] References Cited

U.S. PATENT DOCUMENTS

| | | | |
|---|---|---|---|
| 3,076,541 | 2/1963 | Volckening | 206/232 |
| 3,155,234 | 11/1964 | Knoll et al. | 206/232 |
| 3,347,358 | 10/1967 | Meyers | 206/232 |
| 3,442,378 | 5/1969 | Wolfe | 206/564 |
| 3,497,982 | 3/1970 | Schulz | 206/459 |
| 3,515,265 | 6/1970 | Bartnik | 206/534 |
| 3,606,007 | 9/1971 | Huston, Jr. | 206/564 |
| 3,826,222 | 7/1974 | Romick | 206/564 |
| 4,189,053 | 2/1980 | Stagnitto et al. | 206/534 |
| 4,207,982 | 6/1980 | Maxwell et al. | 206/534 |
| 4,242,140 | 1/1981 | Thrun | 206/459 |
| 4,389,963 | 6/1983 | Pearson | 206/459 |
| 4,526,404 | 7/1985 | Vazquez | 206/232 |
| 4,706,996 | 11/1987 | Fasham | 206/232 |
| 4,752,087 | 6/1988 | Weisbach | 206/459 |
| 4,811,845 | 3/1989 | Baggett | 206/534 |

*Primary Examiner*—David T. Fidei

*Attorney, Agent, or Firm*—Fliesler, Dubb, Meyer & Lovejoy

[57] ABSTRACT

A kit for distributing pharmaceutical products comprising a tray of containers of drugs. Each container is provided with a multipart flag label. The flag label comprises a plurality of self-adhesive stickers which are used for labeling the container and for making entries in inventory records, medical charts, billing statements and the like. To use the kit a prescriber need only insert the patient's name, the date the drug is prescribed and the number of authorized refills on the label. All other information required by law or good practices is preprinted on the label. The stickers are then detached from a protective backing sheet and affixed as indicated.

7 Claims, 4 Drawing Sheets

KIT FOR DISTRIBUTING PHARMACEUTICAL PRODUCTS

BACKGROUND OF THE INVENTION

1. Field of the Invention

The present invention relates to the distribution of pharmaceutical products in general and in particular to a kit, comprising containers of pharmaceutical products with an individual multipart flag label attached to each of the containers, for distributing said products to doctor's offices, medical clinics and any other persons licensed to dispense pharmaceutical products.

2. Description of the Prior Art

Other than "sample" drugs which are frequently dispensed directly to a patient by a physician, most drugs and other pharmaceutical products are distributed to patients through a pharmacy.

For the most part, it has been the practice for a physician to write a prescription for a patient and the patient to then take the prescription to a pharmacy and have it filled. This practice has been both costly and time consuming. It has been costly because it requires a separate drug distribution center, i.e., the pharmacy. It has been time consuming because it takes time for the prescriber to write the prescription and for the patient to have it filled.

In recent years, some pharmaceutical product distributors have been selling pharmaceutical products directly to physicians and medical clinics for resale to patients. This emerging practice saves both the physician and the patient time and money in that the physician does not have to write a prescription, the patient does not have to go to a pharmacy to get the prescription filled and, generally, the cost of distributing drugs in this manner is less with the savings being passed on to the patient. It also provides the dispensing physicians and medical clinics an additional source of income.

While providing certain advantages, prior known direct drug distribution systems, i.e. those involving the sale of pharmaceutical products directly to pharmacies, physicians and medical clinics for resale to patients, have certain disadvantages. For example, in general, they have not provided an adequate means for making it easy for a dispenser to package or furnish drugs, for logging the drugs dispensed, for controlling the inventory of the drugs to be dispensed, or for preparing billing statements or other records for drugs dispensed.

SUMMARY OF THE INVENTION

In view of the foregoing, principle objects of the present invention are a novel method and apparatus for distributing pharmaceutical products directly to physicians and medical clinics for resale to patients.

In accordance with the above objects there is provided a distribution kit. The kit comprises one or more trays of individual containers of drugs, a prescription log record having a plurality of numbered spaces corresponding to each one of the containers in the tray(s) and a package insert containing information pertinent to the drug in the containers.

Attached to each of the trays is a tray label comprising, together with other pertinent information, information identifying the type and the amount of the drugs in the containers, the number of containers in the tray, the number of trays, if two or more trays are being distributed in response to an order, and the identity of the party to whom the drugs are being distributed.

Attached to each of the containers in the tray there is provided a multipart flag label. The multipart flag label comprises a first rectangular sticker having a minor axis, a major axis, a first area, a second area and a third area, a first backing sheet and a second backing sheet. The first area is provided with lines of pre-printed information as required by government regulations on all containers of drugs distributed to the public, including information for identifying the type and the amount of drug in the container. The lines of information in said first area are orientated in a direction parallel to said minor axis and an adhesive is provided on the back thereof for removably attaching the first area to said first backing sheet. The second area is provided with lines of pre-printed information therein including patient directions and precautions which are orientated in a direction parallel to said major axis. The third area is provided with one or more elongated spaces for the manual insertion of information therein and lines of pre-printed information thereon which are orientated in a direction parallel to said minor axis. In addition, the second and third areas, having an adhesive on the back thereof, are removably attached to said second backing sheet.

A plurality of stickers, each having pre-printed information thereon which is visible beyond the edge of said first sticker, is provided with an adhesive on the back thereof and removably attached to a third backing sheet. The third backing sheet is provided with an extended portion which extends from the edge of said plurality of stickers beneath said first sticker. The end of said extended portion is attached to said second backing sheet near the end of said second backing sheet adjacent to an edge of said first backing sheet.

A first one of said plurality of stickers adjacent to said first sticker is provided with a first area which extends beneath said third area of said first sticker.

To minimize the work involved in record keeping, carbon paper or other means is provided for automatically transferring information manually placed in said elongated spaces in said third area on said first sticker to said first area of said first one of said plurality of stickers.

In constructing the kit, one of the multipart labels is attached to each of the containers in a tray by removing the first backing sheet from the first area of the first sticker. The first area is then affixed to the container so that the remainder of the label can be wrapped loosely around the container.

To use the kit, when dispensing a container of drugs from the tray, a physician or other prescriber removes the container from the tray, unwraps the flag label from around the container and lays the container and label on a hard surface such that he can easily fill in the patient's name, the date and number of permissible refills in the elongated space provided therefore at the free end, i.e., third area, of the first sticker. Thereafter, the second backing sheet, the carbon paper and the remaining stickers and their associated backing sheets are removed from the first sticker and the first sticker affixed to the container. The receipt for the drugs is then removed from among the remaining stickers and given to the patient. The remaining stickers are then removed from their backing sheets and used for making entries in the prescription log record, the patient's medical chart, billing statements or other records.

BRIEF DESCRIPTION OF THE DRAWINGS

The above and other objects, features and advantages of the present invention will become apparent from the following detailed description of the accompanying drawing, in which.

DETAILED DESCRIPTION OF THE INVENTION

Figure 1:
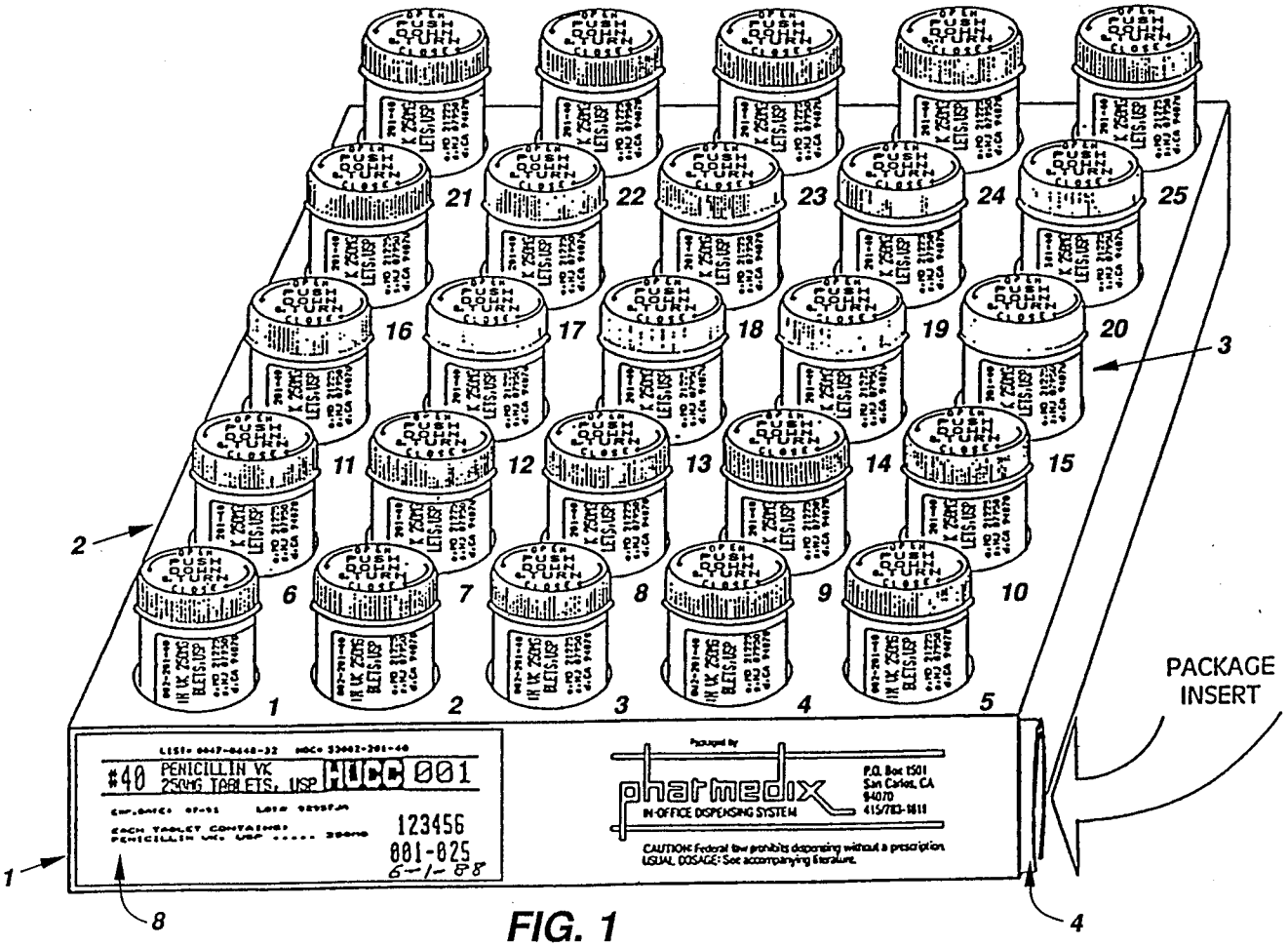
FIG. 1 is a perspective view of a kit used for distributing drugs to physicians in medical clinics or the like in accordance with the present invention.
Figure 4:
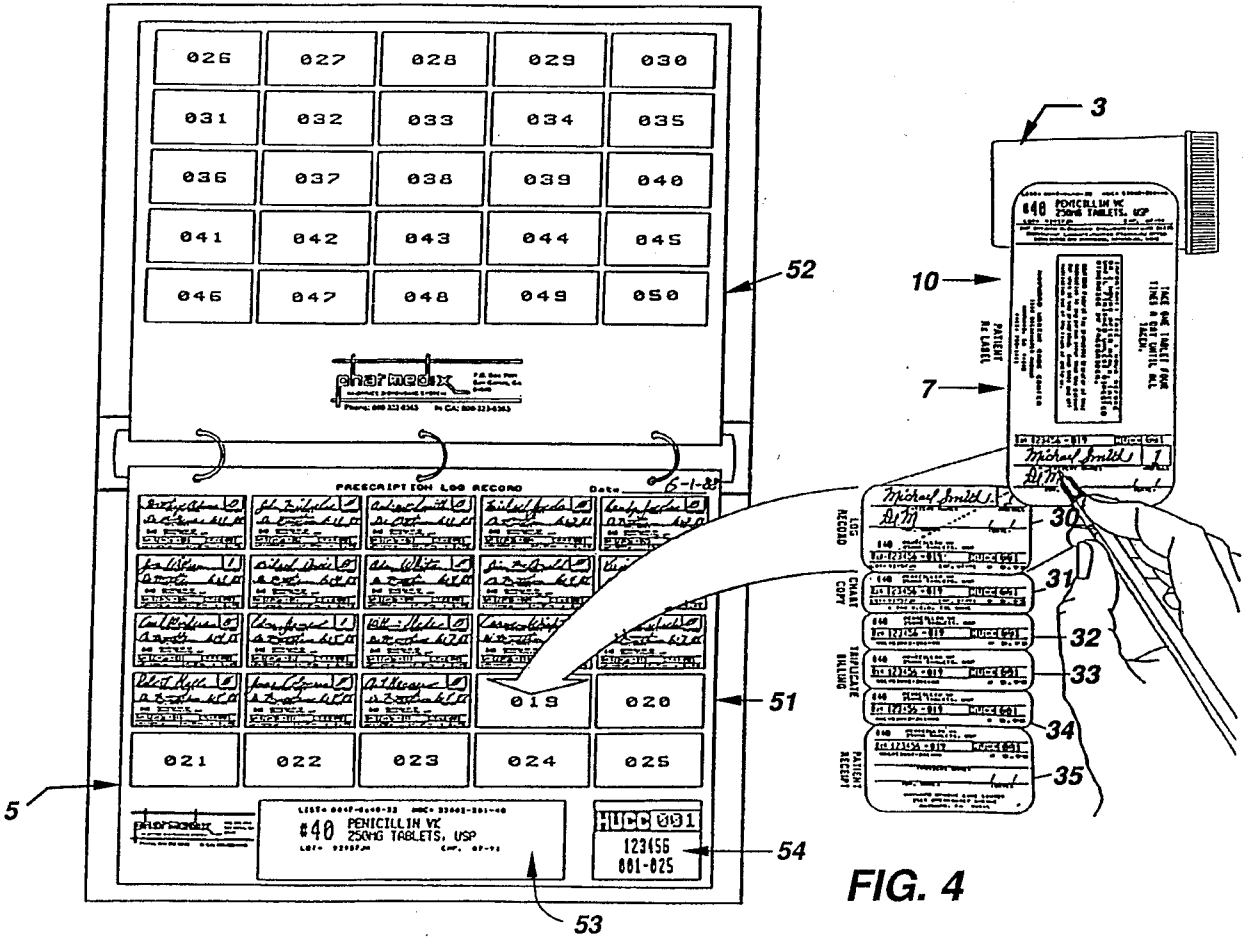
FIG. 4 is a view of a prescription log record according to the present invention.

Referring to FIGS. 1 and 4, there is provided in accordance with the present invention a pharmaceutical dispensing kit designated generally as 1. In the kit 1 there is provided a tray 2, containing a plurality of containers of drugs 3, a package insert 4 and a prescription log record 5.

The tray 2 typically comprises cardboard, which is generally assembled into a hollow box-like shape. In the top surface of the tray 2 there is provided a plurality of numbered holes 6, also designated 1, 2, 3, . . . etc. In each of the holes 6, there is provided one of the containers 3. Each of the containers 3 is provided for containing a particular amount of pharmaceutical drug. For example, 40–250 milligram tablets of Penicillin VK. Attached to each of the containers 3 there is provided a multipart flag label designated generally as 7. On the front of the tray 2 there is provided a tray label designated generally as 8.

Referring in particular to the label 8, there is provided on the label 8 lines of information relating to the type of drugs in the containers in the tray 2, the identity of the physician or the medical clinic to whom the drugs are to be distributed, the number of containers of a batch of drugs in the tray 2, and the batch number of the drugs. For example, referring to List #0047-0648-32, the numbers 0047 comprise the National Drug Code identifying the original manufacturer of the drugs in the containers. The numbers 0648 is the code number assigned by the original manufacturer to identify the type of drug in the containers, and the number 32 is a number assigned by the original manufacturer identifying the quantity of the drug if the drug is a liquid, or the number of units of the drug if in capsule or tablet form. For example, the number 32 is an arbitrary number which may represent 32 capsules, or it may represent 500 capsules.

To the right of the list number there is provided an NDC number, e.g., 53002-201-40. Referring to the NDC number, the numbers 53002 represent a code used for designating the distributor of the drugs. The number 201 is a code used by the distributor for designating the type of drugs in the containers. The number 40 is a code used by the distributor for designating the volume of a liquid in the container, or the number of capsules, or the like, in the containers.

Below the list number and the NDC number there is provided a line of information identifying the type of drug in the containers, e.g., Penicillin VK and the size of the tablets, e.g., 250 milligrams. The letters USP designate that the drugs were made pursuant to a standard specification for the drugs. The letters HUCC identify the physician or medical clinic to which the drugs are being distributed. The numbers 001 is a code adopted by the prescribing physician or medical clinic to identify the drug. The number 40 at the left end of the line is the quantity of drug in each container.

Below the above-described line of information there is provided an expiration date, e.g., 07-91, which identifies the date by which the drugs must be used. To the right of the numbers 07-91, there is provided a lot number 92957JA. The lot number identifies the batch from which the original manufacturer produced the drugs. Below the expiration date and lot number there is provided instructions, and/or information, concerning the drug, and/or an indication of what other brand names are used for the same drug, or the like. On the lower right corner of the label 8 there is provided a number, e.g., 123456, which identified the batch from which the distributor obtained the drugs. Below the batch number is an indication of the number of containers in the batch, e.g., 001–025, and/or the number and sequence of use of the trays in the order, e.g., 1 of 2, 2 of 2. In addition, the shipping date, e.g., 6-1-88, of the batch of drugs to a dispenser is included. When more than one batch of a drug is required in an order, a tray label 8 for each batch is placed on the tray.

Inserted in a space provided therefor in the tray 2, there is provided the package insert 4. The package insert 4 contains information concerning the drugs in the containers 3.

Figure 2:
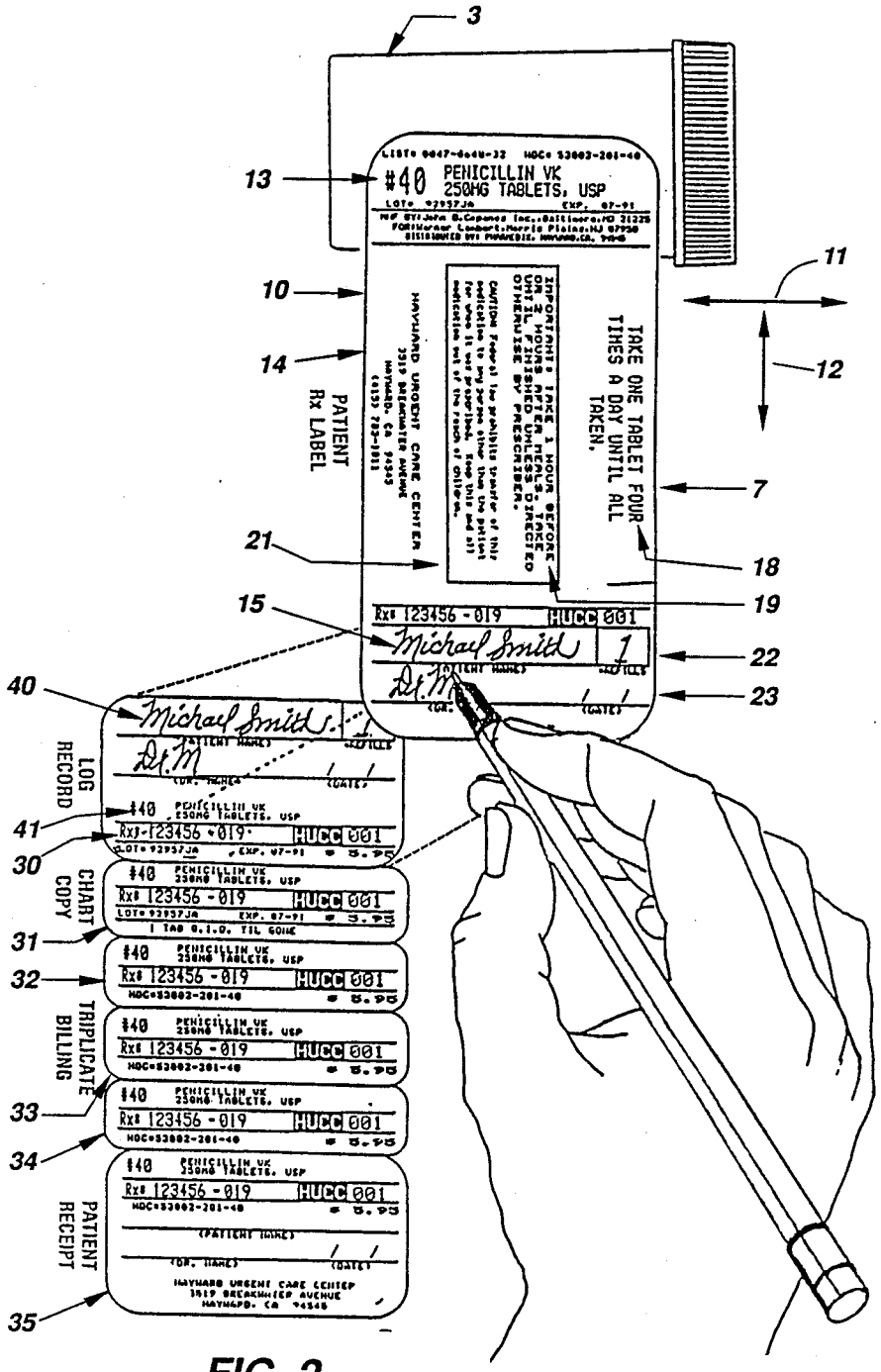
FIG. 2 is a top plan view of a multipart label according to the present invention.
Figure 3:
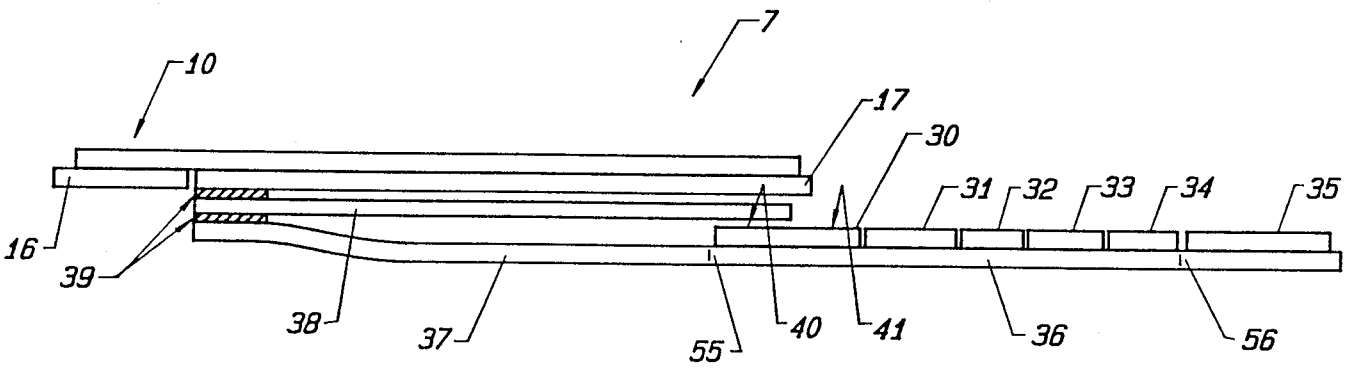
FIG. 3 is a side elevation view of the multipart label of FIG. 2.

Referring to FIGS. 2 and 3, there is shown a top plan view and side elevation view of one of the multipart labels 7. In the label 7 there is provided a first rectangular sticker designated generally as 10. Sticker 10 comprises a minor axis and a major axis which extends in the direction of the arrows 11 and 12, respectively. A first area 13, a second area 14, a third area 15 and, as seen more clearly in FIG. 3, a first backing sheet 16 and a second backing sheet 17.

In the first area 13 there is provided lines of preprinted information which meets or exceeds the requirements of government regulations as to what must appear on a label attached to a container of drugs distributed to the public. For example, as shown in FIG. 2, area 13 contains information identifying the drug, the size of the capsules, e.g., 250 milligrams, the fact that the drug was made according to a standard specification, e.g., USP, a list number, an NDC number, a lot number, and an expiration date, as described above with respect to the tray label 6. The lines of pre-printed information in the area 13 are orientated in a direction parallel to the minor axis 11. Adhesive located on the back of the area 13 is temporarily protected by the first backing sheet 16.

In the second area 14 there is provided lines of preprinted information including, for example, patient directions 18 and precautions 19 pertinent to the drugs in container 3, as well as the name, address and phone number of the prescribing physician or medical clinic 20. For emphasis, the patient precautions 19 and a standard federally required caution message are enclosed within a box 21. The lines of pre-printed information in the area 14 are orientated in a direction parallel to the major axis 12 of the first sticker 10.

In the third area 15 there is provided a line of preprinted information 22 and a plurality of elongated spaces 23. The line 22 comprises the prescription number, e.g., 123456-019, and identifying information identifying the prescriber of the drug and the prescriber's number assigned for the drug, e.g., HUCC and 001, respectively. The elongated spaces 23 are provided for the manual insertion therein of the name of the patient, e.g., Michael Smith, the number of refills, e.g., 1, and the name of the prescribing physician, e.g., Dr. M., as well as the date that the prescription was issued. The areas 14 and 15 are provided on their back surface with an adhesive and removably attached to the backing sheet 17.

Below the first sticker 10 and extending outwardly therefrom, there is provided a plurality of stickers 30, 31, 32, 33, 34, and 35. Each of the stickers 30–35 is provided with an adhesive on the back surface thereof, and removably attached to a third backing sheet 36. The third backing sheet 36 comprises an extended portion 37, which extends from an edge of the sticker 30 beneath said first sticker 10 to a position adjacent to the left end of the second backing sheet 17. Located between the backing sheet 17 and the extended portion of the backing sheet 37, there is provided a sheet of carbon paper 38. The left end of the extended portion 37 and the carbon paper 38 are attached to the left end of the backing sheet 17 as by an adhesive 39.

Sticker 30 is also designated a log record. Sticker 31 is also designated a chart copy. Stickers 32, 33, and 34 are also designated triplicate billing or other record stickers, and sticker 35 is also designated a patient receipt sticker and/or other record sticker.

In sticker 30 there is provided a first area 40 and a second area 41. In the first area 40 there is provided a plurality of elongated spaces which correspond to the spaces 23 in the area 15 of the first sticker 10. In the area 41 of the sticker 30 there is provided pre-printed information, including a prescription number, e.g., 123456-019, the identity of the prescribing physician or medical clinic, e.g., HUCC, a code number which the physician or clinic assigns for the drug prescribed, e.g., 001, the number of capsules in the container, e.g., 40, the name of the drug, and the amount of medication in each tablet, the name of the prescribing physician, and the retail cost of the drug.

As will be seen more clearly in FIG. 3, area 40 is located beneath the third area 15 of the first sticker 10, as well as beneath a section of the carbon paper 38, such that the insertion of information in the elongated spaces 23 in the area 15 will be automatically transferred to the area 40 in the sticker 30.

Referring to sticker 31, in sticker 31 there is provided lines of pre-printed information comprising a code designating the amount of drug prescribed, the name of the drug, the size of the capsules or amount of liquid prescribed, e.g., 40, the name of the drug, e.g., Penicillin VK, the size of each tablet, e.g, 250 milligrams, the fact that the drug was made according to a specific specification, e.g., USP, the prescription number, e.g., 012345-003, the identity of the physician or clinic dispensing the drug, e.g., HUCC, and a code assigned by the physician or dispensing clinic to identify the drug, e.g., 001. Below this information there is provided a lot number identifying the batch from which the drug was made, e.g., 92937JA, the expiration date for the drug, e.g., 01–90, an abbreviation of the patient instructions, e.g., 1 Tab Q.I.D. til gone.

Referring to stickers 32, 33 and 34, each of the stickers 32–34 comprises information containing the distributor's code number for the amount of drug dispensed in the container, e.g., 40, the name of the drug, the size of the tablets, and the specification under which the drug was made, the prescription number, identity of the clinic or physician prescribing the drug, the code number assigned by the physician or clinic identifying the drug, the NDC number of the distributor, and an RVS number identifying the billing category and/or billing code, e.g., 99070, as well as the retail price of the drug.

Referring to sticker 35, sticker 35 provides the same information pre-printed on stickers 32–34 and, in addition, includes the name of the dispensing physician or medical clinic and spaces provided therefor for the manual insertion of the date on which the drug was dispensed and the name of the patient receiving the prescription.

Referring to FIG. 4 there is provided a prescription log record 5. A record 5 is shipped with each batch of drugs shipped and is unique thereto. In the prescription log record 5 there is provided a front page 51 and a back page 52. Pages 51 and 52 comprise a plurality of numbered blocks, e.g., 001–050. At the top of the right corner of the page 51, there is provided the date of the shipment of that batch. The presence of the shipping date on the log record 5 is utilized to determine actual rate of usage of the drugs shipped therewith and thus facilitates reordering without a physical examination of actual inventory. At the bottom of page 51 there is provided pre-printed box 53 containing information identifying the amount of drugs in each of the containers, e.g., 40, the type of drug, e.g., Penicillin VK, the amount of drug in each tablet, e.g., 250 milligrams, the list number of the original manufacturer and the NDC number of the distributor, the expiration date and the lot number, as well as other pertinent information, such as the brand name of equivalent drugs.

To the right of the box 53 there is provided a box 54. In the box 54 there is provided a code identifying the physician or clinic to which the drugs are distributed, e.g., HUCC, and the code assigned by the distributing physician or medical clinic for identifying the drug, e.g., 001. Above this information there is provided an eight digit code which identifies the cost and retail sales price of each container of drugs. Below the identifying information there is provided the first six numbers of the prescription number identifying the batch from which the drug was made. Below the batch number there is provided a number corresponding to the number of containers shipped with the prescription log record, e.g., 001–025 and/or the number and sequence of use of trays where more than one tray is shipped, e.g., 1 of 2, 2 of 2.

An important feature of the present invention is the last three digits of the prescription number, e.g., 019, as can be seen from the completed portions of the prescriptions of the prescription log record 50. While the first six digits of the prescription number on each label inserted in the log is identical for each batch, the last three digits are unique for that label. The last three digits of the prescription number on the label attached to the container corresponds to the same number in the log record. For example, 001 of a batch corresponds to box 001 in the log record and 002 of a batch corresponds to 002 in the log record, and so on.

For purposes of inventory control it is recommended in accordance with the present invention that the containers of drugs in tray 2 be dispensed in a predetermined sequence identified by the prescription number. For example, the first container of drugs to be dispensed from the tray 2 is the container located in the hole on the left end of the first row of containers, namely the container in hole 1. The next container is dispensed from hole 2, and so on.

In assembling the kit 1, one of the multipart labels 7 is attached to each of the containers 3 by removing the backing sheet 16 and pressing the area 13 on the container as shown in FIG. 2. The remainder of the label 7 is then wrapped around the container 3 and the container inserted in the proper hole in the tray 2.

The use of the kit 1 and the prescription log record 5 will now be described in detail.

Referring to FIGS. 2 and 4, assuming that 18 containers of drugs have been dispensed from the tray 2, in preparing to dispense the 19th container, the 19th container is removed from the 19th hole in the tray 2, the loose portion of the flag label 7 attached thereto is unwrapped from around the container and laid on a flat hard surface as shown in FIG. 2. This is possible because only the area 13 of the first sticker 10 is attached to the container 3. With the area 15 of the sticker 10 lying on a flat hard surface, the prescribing physician simply inserts the name of the patient, the number of refills, his/her name, if necessary, and the date of the prescription, in the spaces 23. Thereafter, the physician separates the backing sheet 17 with the remaining stickers attached thereto from the areas 14 and 15 and, wrapping the first sticker around the container 3, affixes the first sticker to the container 3.

As the prescribing physician inserted the patient's name, number of refills, his or her name, and the date the prescription was dispensed, the same information is transferred via the carbon paper 38 to the upper area 40 of the sticker 30. Once the first sticker 10 is separated from the stickers 30–35, the carbon paper 38 and the extended segment 37 of the third backing sheet 36 may be separated from the stickers 30–35 by severing the backing sheet 36 along perforations 55 provided therefor in the backing sheet 36 at the left end of the sticker 30. Similarly, the sticker 35, i.e., the patient's receipt, and its backing sheet may be separated from the stickers 30–34 by severing the backing sheet at perforations 56 and given to the patient.

At a convenient time thereafter the sticker 30 is removed from the backing sheet 36 and inserted in block 019 in the prescription log record 5. Similarly, sticker 31 is removed from the backing sheet 36 and inserted in the patient's medical chart. Stickers 32, 33 and 34 are removed from the backing sheet 36 and affixed to billing statements or other records.

As will be appreciated from the foregoing description of the present invention, the amount of time heretofore required by a doctor in filling out a prescription and the amount of time heretofore required by a patient in having the prescription refilled is significantly reduced, as is the time required for keeping adequate and accurate records of the transaction. Moreover, the apparatus of the present invention provides accurate inventory control, providing the prescriber with a quick means for determining the amount of product in inventory, as well as a mechanism for determining if any of the drugs are stolen from inventory. Furthermore, the information provided on each of the labels and corresponding log record provide a ready means for tracking the drugs dispensed, in the event of a drug recall or for purposes of dispensing an authorized refill of the product. The log record of the present invention allows for ready retrievability of the name of the patient to whom, the date, and the batch information of, and refills authorized for the drug dispensed.

While a preferred embodiment of the present invention is described above, it is contemplated that various modifications may be made thereto without departing from the spirit and scope of the present invention.

For example, while various types of information have been described as being pre-printed on the multipart label of the present invention, various other information and codes may also be used or omitted, as the case may be. Additionally, while carbon paper is described as being used for transferring information written on sticker 10 to sticker 30, it is contemplated that various types of pressure-sensitive stickers may be used for providing the automatic transfer of such information. Accordingly, it is intended that the embodiment described be considered only as an illustration of the present invention and that the scope thereof should not be limited thereto but be determined by reference to the claims hereinafter provided.

What is claimed is:

1. A kit for distributing pharmaceutical products which are prepackaged in individual containers comprising:

a tray having a predetermined number of holes in the top thereof, each of said holes being provided for holding one of said containers in an upright position, said tray having a tray label affixed thereto, said tray label having information printed thereon, said information including information identifying the type and quantity of pharmaceutical product contained in said containers and the party to whom said tray is to be delivered, numbers identifying the number of said containers in said tray and the number of said tray when two or more trays of said containers comprise a single order;

a multipart flag label attached to each of said containers, said flag label having a first rectangular sticker, said first sticker having a minor axis, a major axis, a first area, a second area and a third area, a first backing sheet and a second backing sheet, said first area, having lines of pre-printed information thereon which are orientated in a direction parallel to said minor axis and an adhesive on the back thereof, removably attached to said first backing sheet, said second area having lines of pre-printed information thereon which are orientated in a direction parallel to said major axis, said third area having an elongated space for the manual insertion of information therein and lines of pre-printed information thereon which are orientated in a direction parallel to said minor axis, said second and said third areas, having an adhesive on the back thereof, removably attached to said second backing sheet;

a plurality of stickers, each having pre-printed information thereon which is visible beyond the edge of said first sticker and an adhesive on the back thereof, removably attached to a third backing sheet; said third backing sheet having an extended portion which extends from the edge of said plurality of stickers beneath said first sticker, said extended portion being removably attached at one end to said second backing sheet near the end of said second backing sheet adjacent to an edge of said first backing sheet, a first one of said plurality of stickers adjacent to said first sticker having a first area thereof which extends beneath said third area of said first sticker;

means for automatically transferring information manually placed in said elongated space in said third area on said first sticker to said first area of said first one of said plurality of stickers;

a prescription log record for each batch of drugs shipped, said prescription having a plurality of numbered spaces and the date shipped, each of said numbered spaces corresponding to one of said containers in said tray.

2. A kit according to claim 1 wherein said transferring means comprises a carbon paper-like material located between said third area of said first sticker and said first area of said first area of said plurality of stickers.

3. A kit according to claim 1 wherein each of said stickers in said multipart flag label comprises a sequence number for indicating the sequence in which the container to which said multipart label is attached should be dispensed from said tray.

4. A kit according to claim 1 wherein said sequence number comprises a part of a prescription number identified by the letters Rx.

5. A kit according to claim 2 comprising a number located adjacent to each of said holes which corresponds to said sequence number in the multipart flag label on the container inserted therein for indicating the sequence in which said container should be dispensed from said tray.

6. A kit according to claim 5 wherein said tray comprises a hollow-box-like structure.

7. A kit according to claim 6 wherein said structure comprises cardboard.

* * * * *

UNITED STATES PATENT AND TRADEMARK OFFICE

CERTIFICATE OF CORRECTION

PATENT NO. : 4,976,351

DATED : December 11, 1990

INVENTOR(S) : RICHARD J. MANGINI et al

It is certified that error appears in the above-identified patent and that said Letters Patent is hereby corrected as shown below:

Column 9, line 13, change "area" (second occurrence) to --one--.

Signed and Sealed this

Fifth Day of May, 1992

*Attest:*

DOUGLAS B. COMER

*Attesting Officer*

*Acting Commissioner of Patents and Trademarks*